US009346602B2

(12) United States Patent
Gitta

(10) Patent No.: US 9,346,602 B2
(45) Date of Patent: May 24, 2016

(54) COCKTAIL GLASS

(71) Applicant: Joshua Gitta, Lowell, MA (US)

(72) Inventor: Joshua Gitta, Lowell, MA (US)

( * ) Notice: Subject to any disclaimer, the term of this patent is extended or adjusted under 35 U.S.C. 154(b) by 0 days.

(21) Appl. No.: 14/601,197

(22) Filed: Jan. 20, 2015

(65) Prior Publication Data

US 2015/0203274 A1 Jul. 23, 2015

Related U.S. Application Data

(60) Provisional application No. 61/929,255, filed on Jan. 20, 2014.

(51) Int. Cl.
*B65D 81/32* (2006.01)

(52) U.S. Cl.
CPC ..... *B65D 81/3211* (2013.01)

(58) Field of Classification Search
CPC ..... B65D 81/3205; B65D 81/3211; B65D 81/3288; B65D 81/32
USPC ..... 206/219, 221, 222; 222/129; 426/115–119
See application file for complete search history.

(56) References Cited

U.S. PATENT DOCUMENTS

| | | | | |
|---|---|---|---|---|
| 1,527,227 | A | 2/1925 | Sanders | |
| 1,657,927 | A | 1/1928 | Heinzen | |
| 1,946,981 | A | 2/1934 | Lower | |
| 1,967,469 | A | 7/1934 | Dulany | |
| 2,036,407 | A | 4/1936 | Godfrey | |
| 2,181,612 | A | 5/1939 | Smith | |
| 2,597,522 | A | 5/1952 | Pierce | |
| 2,671,648 | A | 3/1954 | Kost | |
| 2,796,823 | A | 6/1957 | Solomon | |
| 3,331,375 | A | 7/1967 | Hickey | |
| 3,341,089 | A | 9/1967 | Pearsall | |
| 3,404,811 | A * | 10/1968 | Cernei | B65D 81/3211 206/222 |
| 3,718,229 | A | 2/1973 | Wyeth | |
| 3,920,226 | A | 11/1975 | Walt | |
| 3,945,617 | A | 3/1976 | Callery | |
| 4,359,283 | A | 11/1982 | McClellan | |
| 4,598,832 | A | 7/1986 | Alonso | |
| 4,874,618 | A * | 10/1989 | Seaborne | B65D 81/3453 426/115 |
| 5,186,323 | A * | 2/1993 | Pfleger | B65D 81/3211 206/221 |
| 5,402,907 | A | 4/1995 | Liu | |
| 5,695,282 | A | 12/1997 | Hess | |
| 6,105,812 | A | 8/2000 | Riordan | |
| 6,200,015 | B1 | 3/2001 | Gartz | |
| 6,269,979 | B1 | 8/2001 | Dumont | |

(Continued)

OTHER PUBLICATIONS

Anthony, Revolutionary Shot Glass Holds a Shot and Chaser At the Same Time, Oct. 21, 2014, Elite Daily, http://elitedaily.com/envision/revolutionary-shot-glass-holds-shot-chaser-time-video/804779/.

*Primary Examiner* — Bryon Gehman
(74) *Attorney, Agent, or Firm* — Brooklyn Law IP Clinic; Serge Krimnus; Dino Varmaz

(57) ABSTRACT

The present invention provides a mixing apparatus comprising a connector container and a first container, said connector container being adapted to said first container forming a connection area between said connector container and first container, wherein said connection area contains a barrier between said connector and first containers, wherein said barrier is capable of preventing the passage of a substance contained in the connector or first container, wherein, upon user intervention, said barrier is capable of allowing the passage of a substance contained in the connector or first container.

10 Claims, 5 Drawing Sheets

(56) References Cited

U.S. PATENT DOCUMENTS

| | | | | |
|---|---|---|---|---|
| D453,089 | S | 1/2002 | Neidigh | |
| 6,450,368 | B1 | 9/2002 | De LaForcade | |
| 7,066,323 | B1 * | 6/2006 | Reisman | B65D 81/3211 206/222 |
| 7,299,936 | B2 | 11/2007 | Singh | |
| 7,308,915 | B2 | 12/2007 | Johns | |
| 7,506,754 | B2 | 3/2009 | Segovia | |
| 7,537,112 | B2 | 5/2009 | Balazik | |
| 7,614,512 | B2 | 11/2009 | Nader | |
| 7,851,003 | B2 | 12/2010 | Zeng | |
| 7,946,752 | B2 | 5/2011 | Swartz | |
| 8,226,126 | B2 * | 7/2012 | Johns | A61J 1/2089 206/222 |
| 8,313,644 | B2 | 11/2012 | Harris | |
| 8,534,908 | B2 | 9/2013 | Rhodes | |
| 8,550,303 | B2 | 10/2013 | Greer | |
| 2004/0118710 | A1 | 6/2004 | Bourque | |
| 2005/0109213 | A1 | 5/2005 | Terada | |
| 2006/0000361 | A1 | 1/2006 | Kutyev | |
| 2006/0237355 | A1 | 10/2006 | Knapp | |
| 2008/0023347 | A1 | 1/2008 | Wahl | |
| 2008/0179334 | A1 | 7/2008 | Abramson | |
| 2010/0024660 | A1 | 2/2010 | Wallace | |
| 2010/0163439 | A1 * | 7/2010 | Gutierrez Avendano | B65D 81/3211 206/219 |
| 2012/0318766 | A1 | 12/2012 | Questad | |
| 2013/0001120 | A1 | 1/2013 | Yaron | |
| 2013/0336085 | A1 * | 12/2013 | Drake | B65D 81/3211 206/219 |

* cited by examiner

COCKTAIL GLASS

INTRODUCTION

The present invention relates generally to a mixing apparatus, and more particularly to a pre-filled mixing container with a plurality of separate compartments.

Some embodiments of this invention relate to mixing apparatus for alcoholic mixed drinks, which are preferably mixed immediately prior to consumption. In a bar or restaurant setting without the present invention, mixed alcoholic drinks are made by a bartender who takes a customer's order, selects individual ingredients, separately pours the ingredients into a single container, and then mixes them. This process is time consuming, inaccurate, non-hygienic, tiresome, and untidy.

Some embodiments of this invention relate to other liquids, ingredients, and materials beyond alcoholic drinks. For example the invention may be used with soft drinks, juices, smoothies, coffee, tea, fruits, and industrial products such as chemicals.

SUMMARY OF THE INVENTION

The present invention has been made to address at least the above problems and/or disadvantages and to provide the advantages described below. Accordingly, an aspect of the present invention provides a mixing apparatus comprising a connector container and a first container, said connector container being adapted to said first container forming a connection area between said connector container and first container, wherein said connection area contains a barrier between said connector and first containers, wherein said barrier is capable of preventing the passage of a substance contained in the connector or first container, wherein, upon user intervention, said barrier is capable of allowing the passage of a substance contained in the connector or first container.

BRIEF DESCRIPTIONS OF THE DRAWINGS

The above and other aspects, features and advantages of certain embodiments of the present invention will be more apparent from the following detailed description taken in conjunction with the accompanying drawings, in which.

While the invention is described with reference to the above drawings, the drawings are intended to be illustrative, and the invention contemplates other embodiments within the spirit of the invention.

DETAILED DESCRIPTION

The following detailed description of various embodiments of the present invention will be made in reference to the accompanying drawings. This invention may, however, be embodied in many different forms and should not be construed as limited to the embodiments set forth herein. Among other things, the present invention may be embodied as methods or devices. In describing the present invention, explanation about related functions or constructions known in the art are omitted to avoid obscuring the present invention with unnecessary detail.

According to aspects of a mixing apparatus or method according to an embodiment of the invention, the apparatus or method may create a mixed drink. The manufacturer of the apparatus may package the desired amount of a substance into separate containers of the apparatus and connect the containers while using barriers to keep the contents each container separate. The user of the device may twist the containers to initiate a mechanism that allows the substances to pass through the barriers and mix with the substances of the other containers. A consumer may then consume the mixed substance.

The mixing apparatus may be used in a wide variety of circumstances. For instance, bars and restaurants may wish to speed up the process of serving a mixed drink, reduce cleanup, and provide their customers with uncontaminated and accurately measured beverages. Further, individuals may wish to use the device while traveling with a cooler, where space is limited, than to carry multiple separate bottles. Additionally, there are any number of possible situations and circumstances where a mixing apparatus may be desired.

In regards to the accompanying drawings, not all of the components may be required to practice the invention, and variations in the arrangement and types of components may be made without departing from the spirit or scope of the invention.

Figure 1:
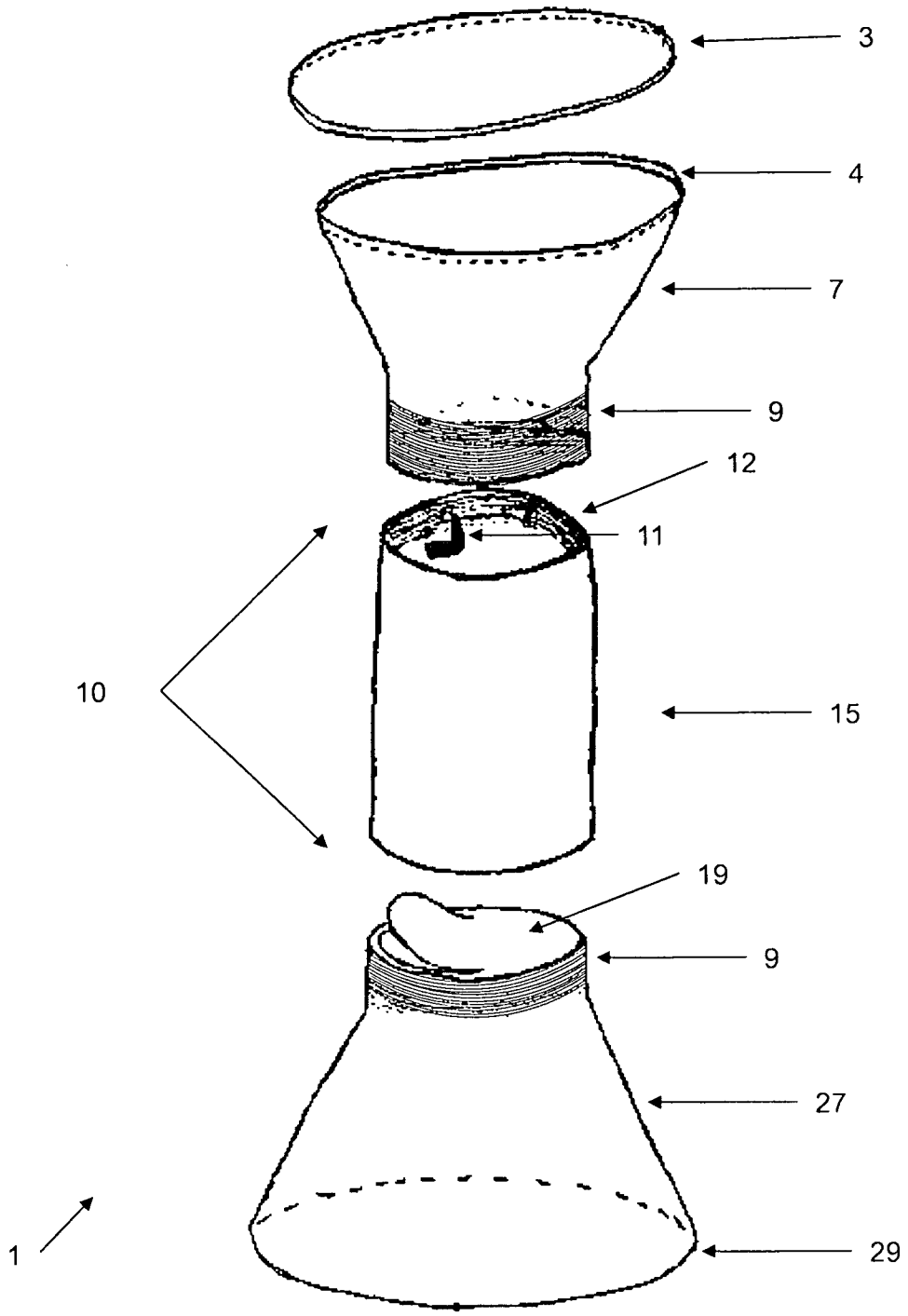
FIG. 1 is an exploded side perspective view of a mixing apparatus.

FIG. 1 illustrates components of a mixing apparatus 1 according to an embodiment of the invention. As shown, mixing apparatus 1 may be composed of three different containers stacked on top of one another: a first container on top, a connector container in-between, and a second container on bottom. The first container 7 may have a distal portion and proximal portion. The proximal portion may be closer to the connector container and the distal portion may be further from the connector container. The first container may be cone shaped wherein the distal portion has a wider diameter than the proximal portion. The proximal portion may straighten out into a cylindrical ending, which may have outer interlocking spiral grooves 9 on the outer surface of the cylindrical ending. The cylindrical ending may contain a barrier 19 inside if it. The distal portion of the first container may contain a removable member 3 to allow a user to access a substance inside the mixing apparatus.

The distal end of the first container 7 may be designed so that once the removable member 3 is removed, a user can comfortably drink the contents of the mixing apparatus, as if it were a regular glass or cup. The removable member 3 could be removable using any number of different designs including but not limited to a twist off, pressure sealed, plastic wrapped, or snap in place design. The removable member may be designed to easily re-attach to the first container in case the consumer would not like to finish the beverage in one setting. In one embodiment, the removable member is a planar cap that sits securely on an inner lip 4 of the first container 7 until it is removed by the user.

The connector container 15 may have a top portion, which may connect to the first container, and a bottom portion, which may connect to the second container. The connector container may be cylindrically shaped with a hollow center that opens at the top and bottom portion's sides. The inner surface of both the top portion and bottom portion may contain inner interlocking spiral grooves 12 and puncturing members 11. The puncturing members may be attached to the inner wall of the connector container and may be "L" shaped with a tip sharp enough to puncture and cut through the barrier 19. The tip of the puncturing member 11 on the top portion may point in the direction of the top portion opening. The tip of the puncturing member 11 on the bottom portion may point in the direction of the bottom portion opening. The puncturing member 11 on the bottom and top portions may be located on opposite sides of the inner wall. This may cause liquids from the top and bottom portions to enter the connector container from opposite sides resulting in a spiral mixing effect that may increase mixing and may be aesthetically pleasing to the user. The puncturing member 11 may be made of a variety of materials including but not limited to plastic, metal, or wood.

The second container 27 may have a distal portion and proximal portion wherein the proximal portion may be closer to the connector container 15 than the distal portion. The second container may be cone shaped where the distal portion has a wider diameter than the proximal portion. The proximal portion may straighten out into a cylindrical ending, which may have outer interlocking spiral grooves 9 on the outer surface of the cylindrical ending. The cylindrical ending may contain a barrier 19 inside if it. The distal portion of the first container may contain a base 29 at its distal-most end, which may be designed to rest on a flat surface.

The outer interlocking spiral grooves 9 of the first and second containers may be compatible with and connect to the inner interlocking spiral grooves 12 of the connector container in a connection area 10. For example, as the first container and connector container are rotated in opposite directions, their respective grooves may interlock with each other to bring the containers closer to each other and prevent them from separating. The outer and inner interlocking spiral groves are designed to create a tight seal to allow a liquid or other substance to pass between containers without leaking.

The barrier 19 may prevent a substance from entering or exiting the first container. The barrier may contain an adhesive so it may stay securely in place on a container. The barrier may be made of a variety of different materials, including but not limited to any combination of plastic, aluminum, or paper. The barrier may be made of a material that would not contaminate an edible substance, such as a beverage. Further, the barrier itself may be edible in case it detaches from the container. The barrier may be a variety of different designs. In one such design, the barrier may consist of a layer that rests flat on the cylindrical ending openings of the first or second container and may be secured in place with an adhesive. To puncture the barrier the user may twists containers to interlock the inner and outer grooves 9, 12, which will draw the containers closer to each other and the puncturing member 11 on the connector container will eventually puncture the barrier. To allow a substance to pass through the barrier, the user may continue to twist the containers so the puncturing member 11 will cut a circular slit along the outside perimeter of the barrier. Once a semi-circular cut is achieved, the user may cease twisting. A semicircular cut may allow a substance to flow freely between the containers, while keeping the barrier securely attached to the barrier.

Figure 2:
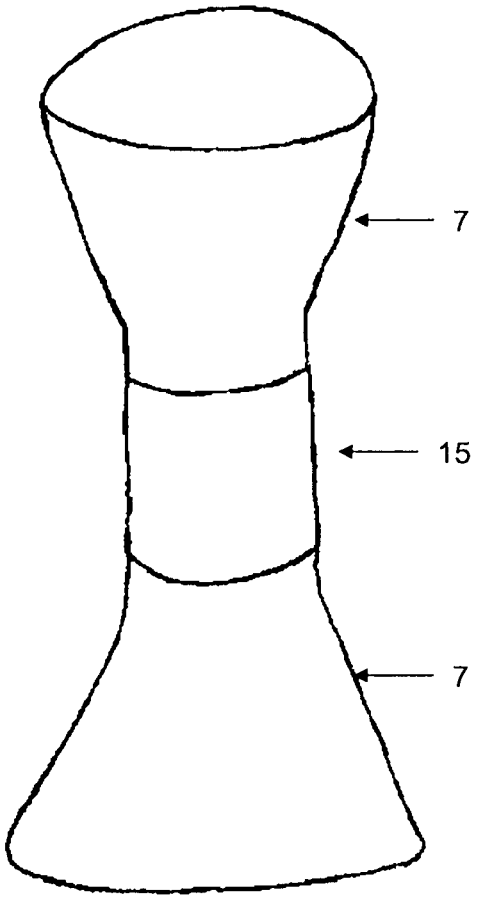
FIG. 2 is an assembled side perspective view of a mixing apparatus.

FIG. 2 illustrates an assembled view of the mixing apparatus 1. The device may be sent to the user pre-assembled, or the individual containers may be sent separately to allow the user to mix and match different prefilled containers.

Figure 3:
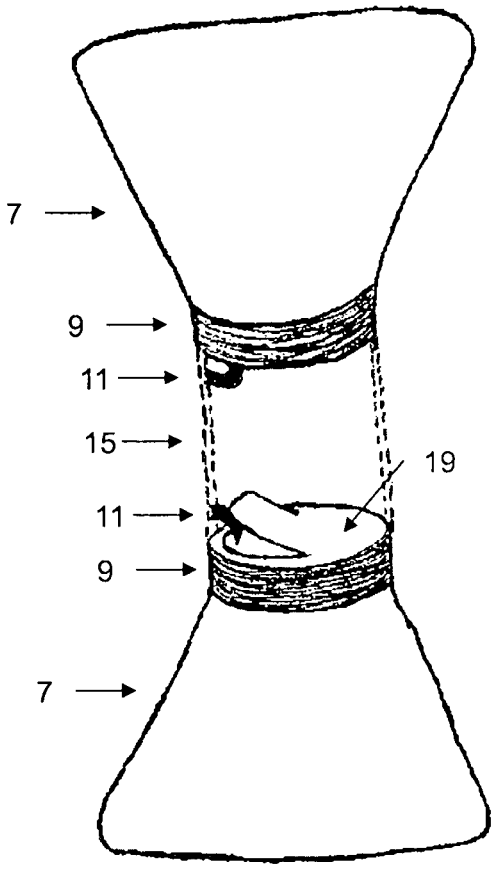
FIG. 3 is an assembled side perspective view of a mixing apparatus with the connector container cut away.

FIG. 3 illustrates an assembled view of the mixing apparatus 1 with the walls of the connector container 15 cut away in order to show the puncturing member 11 after it has broken through the barrier 19.

Figure 4:
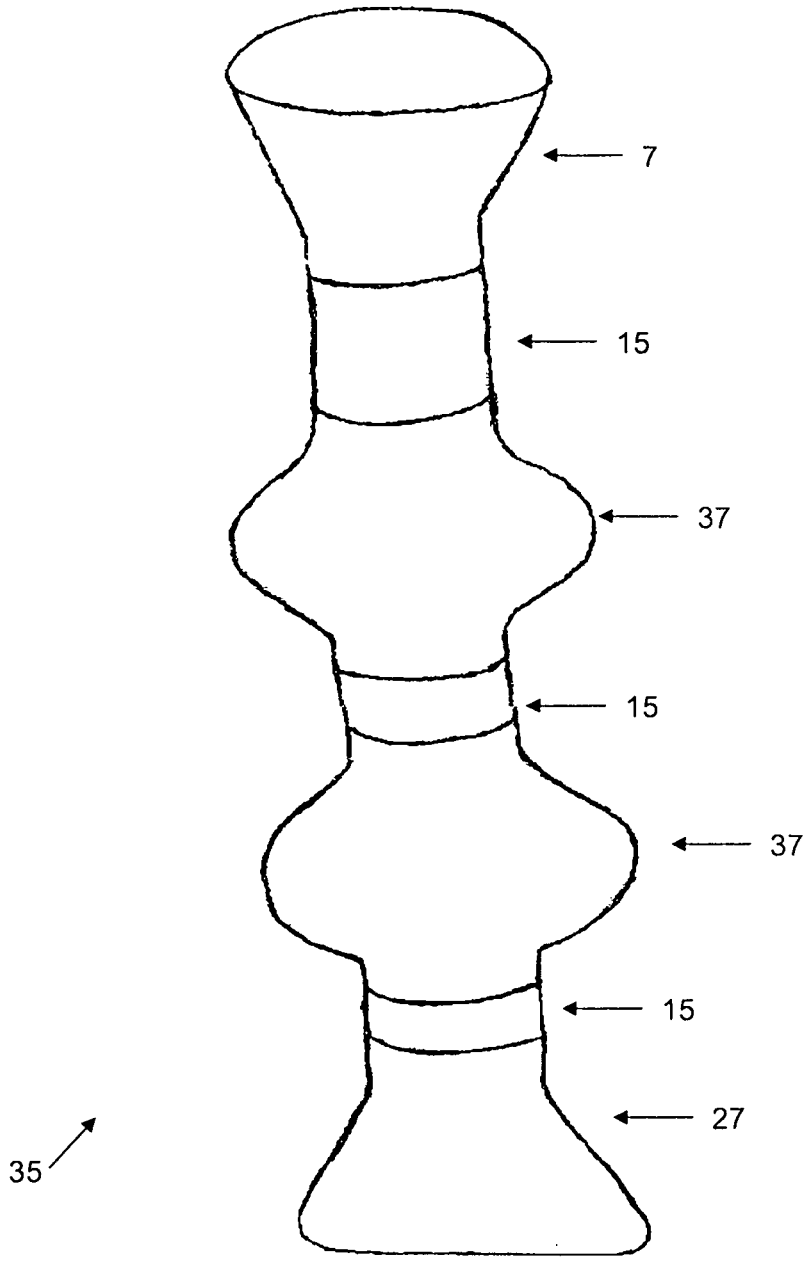
FIG. 4 is an assembled side perspective view of a mixing apparatus with seven containers.
Figure 5:
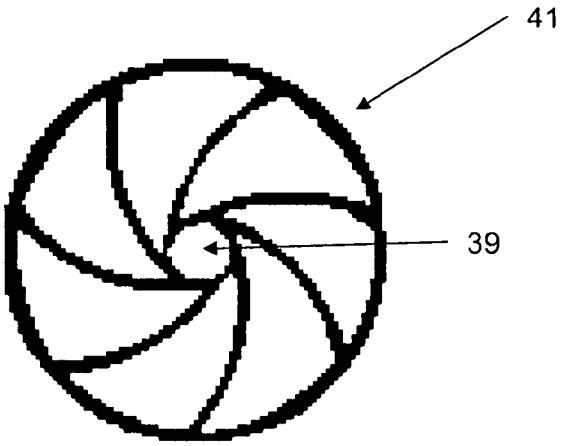
FIGS. 5 to 8 are an embodiment of a diaphragm mechanism.
Figure 6:
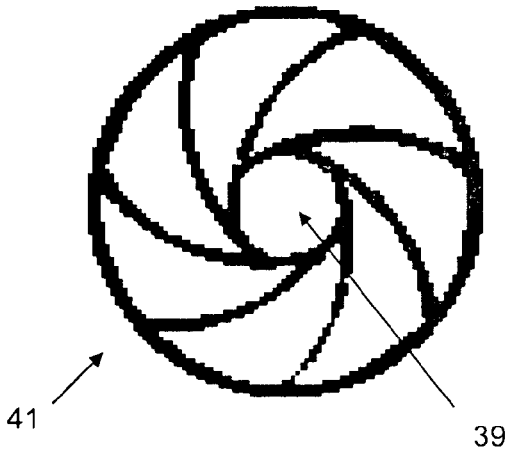
Figure 7:
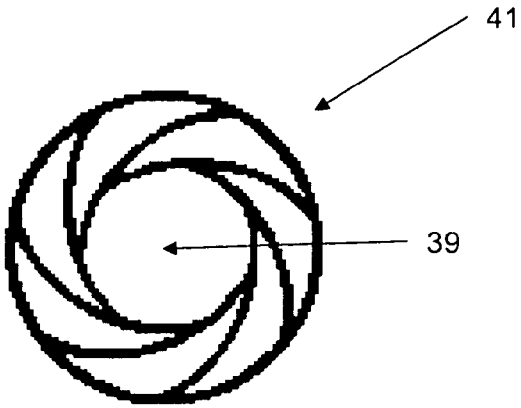
Figure 8:
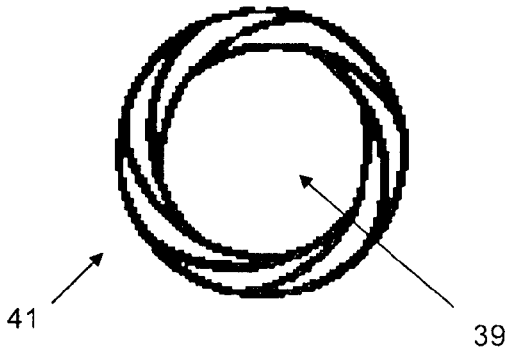

FIG. 4 illustrates an assembled view of a mixing apparatus with additional containers 35 consisting of a modified second container 37 adapted to connect with a connector container on both its proximal and distal ends. The mixing apparatus with additional containers 35 contains seven total containers, however, any number of containers may be used.

FIGS. 5 to 8 illustrate an alternative embodiment of the barrier 19 wherein the barrier 19 is a diaphragm mechanism 41 with an aperture 39. The aperture opens and closes in response to a rotation of the containers. The diaphragm mechanism may be designed similar to optics diaphragms found in camera lenses wherein, in response to a rotation, the diaphragm elements may overlap onto themselves. This overlap may create an aperture 39 and allow a substance to pass through.

Figure 9:
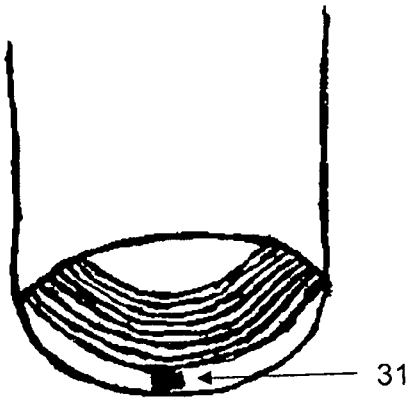
FIG. 9 is a side perspective view of a connector container with an indentation.
Figure 10:
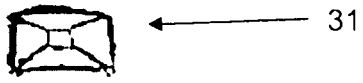
FIG. 10 is an embodiment of an indentation.
Figure 11:
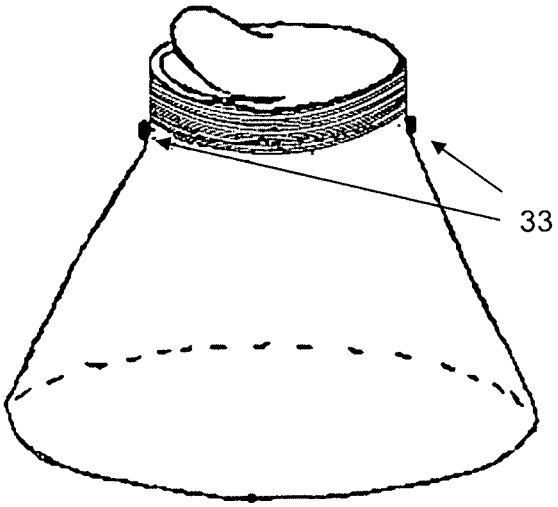
FIG. 11 is a side perspective view of a second container with protrusions.

FIGS. 9 to 11 illustrate an indicator that may alert the user that continued rotation would allow a substance to pass through the barrier. The indicator may consist of one or more protrusions 33 on one container and one or more corresponding indentations 31 on another container that the protrusion may fit inside of. For example, as a user twists the containers and the puncturing member 11 draws closer to the barrier 19, the protrusion 33 may fall into in the indentation 31 immediately prior to the puncturing member making contact with the barrier. This may change the force required to twist the containers, which may indicate to the user that if they continue to twist, the barrier may break. Alternatively, the manufacturer may ship the mixing apparatus 1 with the protrusion 33 securely located in the indentation 31 so the user only requires a minimal twisting motion to puncture the barrier 19. Further, the apparatus may consist of a second indicator to alert the user when they should cease twisting, for example when the barrier is sufficiently broken.

The mixing apparatus may be made of a wide variety of materials. For example, any combination of glass, plastic, wood, polythene, water resistant cloth, leather, and metal may be used for any element of the device. The containers may be made of a transparent material, such as certain types of glass or plastic, to allow the user to observe the substance inside and visually see the mixture process take place.

All of the containers may be made of a wide variety of shapes including but not limited to spherical, cylindrical, rectangular, and hexagonal. Furthermore, the containers could be shaped as recognizable figures or designs, for example the shape of a pineapple or action figure.

The containers may ship from the manufacturer pre-assembled, or separately. In a pre-assembled embodiment, the manufacturer may place a substance in each of the first, second, and connector containers. A substance would remain in in the connector container since the substance would be fully contained by the barriers of the surrounding first and second containers. The manufacturer may leave space in the connector container because the volume may reduce as the users twist the containers together.

In an alternate embodiment, the containers may ship as separately packaged units where the user may select any combination of containers they desire. The connector container may be shipped empty or may be filler and contain a removable top and bottom. If the connector container is shipped as a separately packaged unit with a substance inside, the connector container may contain a removable seal on the top and bottom to keep the substance contained during shipment and storage. To assemble the separately packaged containers, the user may orient the connector container perpendicularly to the ground and remove the top seal. The user may then connect a container to the top of the connector container. The user may then turn the two connected containers upside down and remove the seal on the opposite side of the connector container before attaching another container to that side.

In an alternate embodiment, the containers may ship as empty containers where the user may fill the containers with any substance they desire. The containers may be sold with barrier units and seals that the user may attach to the containers after filling them. Alternatively, the user may fill the container through a removable opening located anywhere on the containers.

In an alternative embodiment, the barrier 19 may be broken by a spring mechanism wherein the consumer pushes the first and second containers toward each other and the puncturing member pierces the barriers as the spring compresses. The puncturing members may be redesigned to puncture a semicircle in the barrier as they puncture, instead of being twisted to cut a semicircle.

In an alternative embodiment the connector container could be made of cloth or leather. A zipper could be introduced whereby the zipper is connected to the puncturing member. Upon pulling the zipper around the apparatus, the puncturing member may also cut the barrier members at the same time. The zipper further creates a seal and prevents leaks.

The invention claimed is:

1. A mixing apparatus comprising:

a connector container, a first container, and a second container, a first connection area formed when said connector container is coupled to said first container, a second connection area formed when said connector container is coupled to said second container, wherein said first connection area contains a first barrier between said connector container and said first container, wherein said second connection area contains a second barrier between said connector container and said second container, wherein said first barrier is arranged to prevent the passage of a substance contained in the connector container or the first container, wherein said second barrier is arranged to prevent the passage of a substance contained in the connector container or the second container, wherein the inner surface of said connector container comprises a first puncturing member and a second puncturing member, wherein said first puncturing member is configured to puncture said first barrier and said second puncturing member is configured to puncture said second barrier upon rotation of said connector container relative to said first container or said second container, allowing the passage of a substance contained in the first container or the second container.

2. The mixing apparatus of claim 1, wherein liquid cannot pass through the first barrier or the second barrier.

3. The mixing apparatus of claim 1, wherein said connector container is attached to said first container using interlocking spiral grooves and said connector container is attached to said second container using interlocking spiral grooves.

4. The mixing apparatus of claim 3, wherein an initial rotation of said connector container relative to said first container or to said second container causes the containers to remain connected and a further rotation causes said first barrier or said second barrier to be punctured by the puncturing members.

5. The mixing apparatus of claim 4, wherein said first connection area or said second connection area contains an indicator to alert a user that continued rotation will allow a substance to pass through the first barrier or the second barrier.

6. The mixing apparatus of claim 5, wherein said indicator consists of a protrusion on one container that fits inside an indentation of another container.

7. The mixing apparatus of claim 1, wherein the first container contains a removable member that allows a user to access a substance inside said first container.

8. The mixing apparatus of claim 1, wherein said first barrier or said second barrier is edible.

9. The mixing apparatus of claim 1, wherein said connector container is cylindrical in shape.

10. The mixing apparatus of claim 1, wherein said first container contains a proximal end and a distal end relative to said connector container, and the distal end has a larger circumference relative to a circumference of the proximal end.

* * * * *